US006487956B1

(12) United States Patent
Holm et al.

(10) Patent No.: US 6,487,956 B1
(45) Date of Patent: Dec. 3, 2002

(54) POSITIONER

(75) Inventors: Staffan Holm, Stockholm (SE); Mikael Eriksson, Sollentuna (SE); Johan Holmberg, Haninge (SE)

(73) Assignee: Palmstierna Instrument AB, Solna (SE)

( * ) Notice: Subject to any disclaimer, the term of this patent is extended or adjusted under 35 U.S.C. 154(b) by 0 days.

(21) Appl. No.: 09/686,974

(22) Filed: Oct. 12, 2000

(30) Foreign Application Priority Data

Oct. 12, 1999 (EP) ..... 99850148

(51) Int. Cl.[7] ..... F15B 13/044
(52) U.S. Cl. ..... 91/459; 91/461
(58) Field of Search ..... 91/454, 31, 461, 91/459

(56) References Cited

U.S. PATENT DOCUMENTS 3,175,581 A * 3/1965 Brandenberg et al.
3,707,163 A * 12/1972 Hugler

FOREIGN PATENT DOCUMENTS

| | | | |
|---|---|---|---|
| DE | 196 35 368 C1 * 12/1997 | ..... | G05D/3/12 |
| EP | 0 703 369 A2 * 3/1996 | ..... | F15B/13/08 |
| EP | 0 703 369 A3 * 3/1996 | ..... | F15B/13/08 |
| EP | 0 855 520 A1 * 7/1998 | ..... | F15B/13/042 |

* cited by examiner

*Primary Examiner*—Edward K. Look
*Assistant Examiner*—Michael Leslie
(74) *Attorney, Agent, or Firm*—Fish & Richardson P.C.

(57) ABSTRACT

The present invention relates to an electro-pneumatic positioner for use with a pneumatically controlled two-chamber actuator comprising a first valve unit (10) comprising a first air supply valve (14) and a first air outlet valve (37) connected to a conduit (30, 38, 50), which in turn is connectable to a chamber of the actuator, a second valve unit (12) comprising a second air supply valve (14') and a second air outlet valve (37') connected to a conduit (30', 38', 50'), which in turn is connected to a second chamber of the actuator; a first control device (60, 74) acting on the first air supply valve, which first control device comprises a first control valve (60); a second control device (60', 76) acting on the said second air supply valve, which second control device comprises a second control valve (60'). The invention is characterized in that said first control device further comprises a first air supply means (74) able of supplying pressurized air to said first air supply valve (14) and that said first control valve (60) acts on and controls said first air supply means (74); that said second control device further comprises a second air supply means (76) able of supplying pressurized air to said second air supply valve (14') and that said second control valve (60') acts on and controls said second air supply means (76); that said first air supply means (74) is able of supplying air to said second air outlet valve (37'), and that said second air supply means (76) is able of supplying air to said first air outlet valve (37).

14 Claims, 4 Drawing Sheets

POSITIONER

TECHNICAL FIELD

The present invention relates to an electro-pneumatic positioner for use with a pneumatically controlled two-chamber actuator comprising a first valve unit comprising a first air supply valve and a first air outlet valve connected to a conduit, which in turn is connected to a chamber of the actuator, a second valve unit comprising a second air supply valve and a second air outlet valve connected to a conduit, which in turn is connected to a second chamber of the actuator; a first control device acting on the first air supply valve, which first control device comprises a first control valve; a second control device acting on the said second air supply valve, which second control device comprises a second control valve.

BACKGROUND OF THE INVENTION

Positioners are widely used in many applications, such as controlling the opening degree of valves in different processes. With these pressurised fluid is controlled and directed to the chambers of an actuator, often in the form of a cylinder/piston arrangement.

In recent years so called electro-pneumatic positioners have come in use. These often comprise piezo-electrical valves controlling the flow of pressurised air through the positioner in response to electrical signals to the piezo-electrical valves.

One type of electro-pneumatic positioner is described in patent document DE 196 35 368. The positioner comprises two main valve units, each comprising a main air supply valve and a main air outlet valve. Each unit is in communication with a respective chamber of an actuator. Each valve unit is controlled by a piezo-electrical control valve acting on a switch valve in the main air supply valve. As shown in the drawing of the patent, air via the control valve acts directly on the switch valve.

Further in order to have a simplified function of the positioner, a type of cross-connection is made, whereby the main outlet air valve of the first valve unit is controlled by air taken from the switch valve of the further main air supply valve and that the main outlet air valve of the further valve unit is taken from the switch valve of the first main air supply valve. With this cross-connection only two piezo-electrical valves are required to control two supply valves and two outlet valves, thus simplifying the overall design and reducing the manufacturing costs.

One major drawback with the solution according to DE 196 35 368 is that, as mentioned above, the piezo-electrical valve acts directly on the membrane of the air supply valve. Since the air pressure of the air supply is small, in the order of 1–1.5 bar, and the air orifices in the piezo valve are rather small in order for the valve to be able to close, the air flow will consequently be small, typically in the order of 1.5 1/min. This rather small air flow acting on the membrane of the air supply valve gives rise to a slow reaction of the supply valve in response to an opening of the piezo-electrical valve. This also puts a restraint on the size of the valve openings in the air supply valve.

Another drawback with the positioner according to DE 196 35 368 is that the pressurised air for controlling the air outlet valves is taken from the outlet of the air supply valves. This means in practice that there probably is a certain delay in the system. If for instance the positioner is to activate one side of the actuator, one of the piezo-electrical valves opens and provides air to the air supply valve of one of the valve units, which in turn opens a passage for the process air supply, e. g. an air compressor, which is led to one chamber of the actuator. This process air supply is further led to the air outlet valve of the other valve unit. Since there is a certain sequential activation of the valves a delay might be obtained.

Another disadvantage with working directly with the process air is that the pressure is known to fluctuate somewhat. Due to these fluctuations in pressure the controlling force on the air outlet valves fluctuate also, which means unpredictable variations in control characteristics.

BRIEF DESCRIPTION OF THE INVENTION

The aim of the present invention is to provide a positioner which remedies the above problems, which provides a positioner with better performance and faster and more reliable control characteristics.

In this context it is to be understood that the word positioner comprises both positioners able of positioning an actuator at any position along its stroke as well as positioning an actuator at its end positions, i e a sort of on-off function.

According to one aspect of the invention this aim is obtained by a positioner according to the preamble of patent claim 1 characterised in that said first control device further comprises a first air supply means able of supplying pressurised air to said first air supply valve and that said first control valve acts on and controls said first air supply means; that said second control device further comprises a second air supply means able of supplying pressurised air to said second air supply valve and that said second control valve acts on and controls said second air supply means; that said first air supply means is able of supplying air to said second air outlet valve, and that said second air supply means is able of supplying air to said first air outlet valve. According to another aspect of the invention, it is characterised in that the air flow rate that the air supply means are able of supplying are substantially larger than the air flow rate that the control valve is able of supplying in order to control the air supply means.

There are several benefits with the invention. By using an air supply means controlled by the control valve, much larger air flow rates are obtainable for controlling the valves of the positioner, than with positioners according to the state of the art, where the air flow from the control valve was used directly to control the valves of the positioner. That becomes especially noticeable with piezo-electrical control valves, which only can cope with airflow rates in the order of 0.5 1/min. One of the benefits with a larger air flow rate is that the response time for the positioner valves is greatly reduced, providing a quicker reaction of the positioner upon a control signal.

Further with the larger air flow rates, the power obtainable for controlling the valves of the positioner is increased, i e larger membrane and piston areas may be used, thereby providing for the possibility of having larger openings in the valves with maintained valve performance and characteristics. These larger openings reduce the risk of particles in the pressurised air depositing inside the valve and disrupting the function.

Preferably the pressurised air that the air supply means obtains from the air supply source has passed a pressure regulator valve. In doing this a predictable pressure level is obtained for controlling the valves, which is important in order to achieve reliable and predictable characteristics of the positioner and thus the actuator.

These and other aspects of, and advantages with, the present invention will become apparent from the following detailed description of a preferred embodiment of the invention with reference to the accompanying drawings.

BRIEF DESCRIPTION OF THE DRAWINGS

In the following detailed description of a preferred embodiment of the present invention, reference will be made to the accompanying drawings, of which

DETAILED DESCRIPTION OF THE INVENTION

Figure 1:
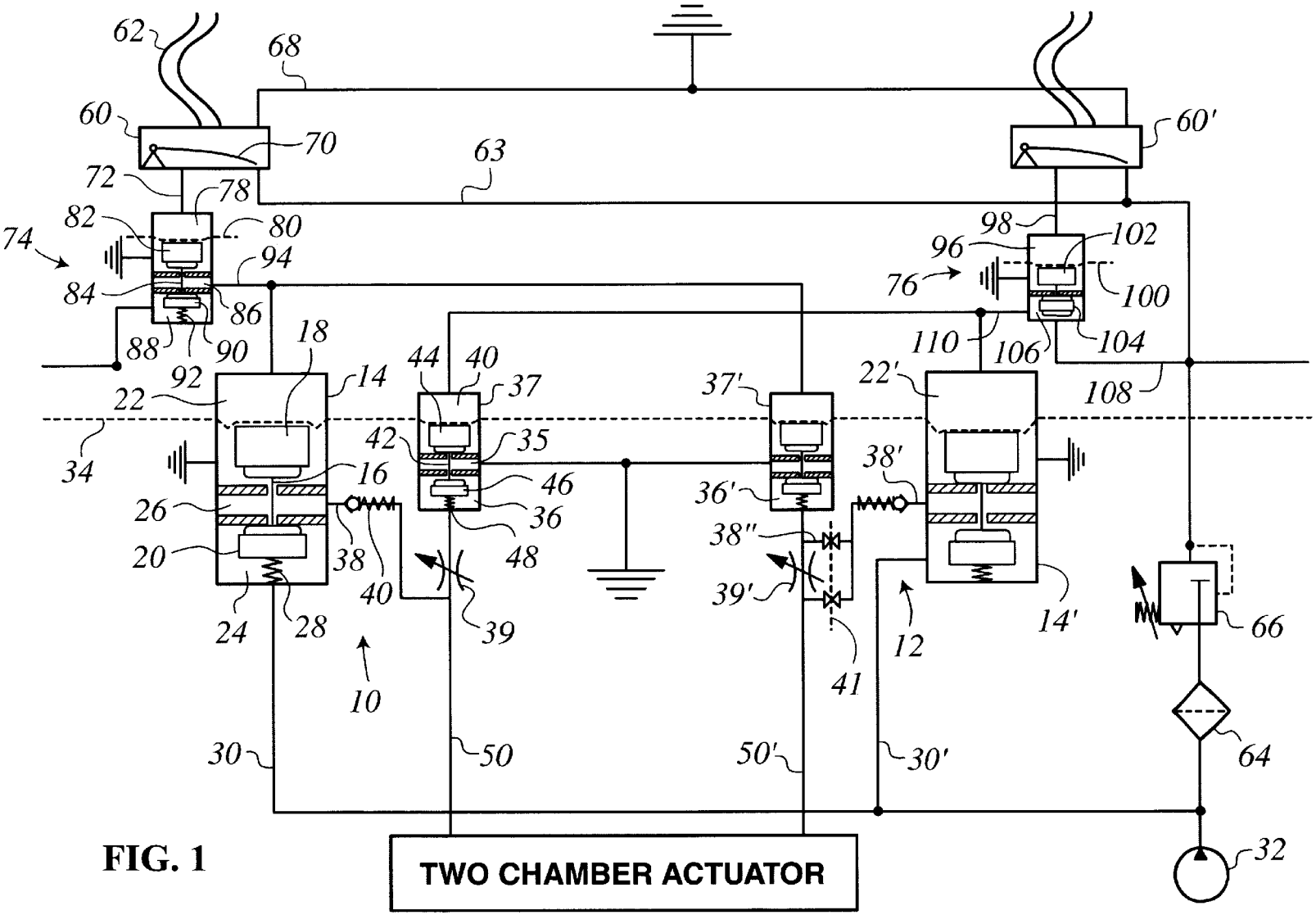
FIG. 1 shows a schematic connection diagram of the present invention with control valves in certain positions.

FIG. 1 shows a connection diagram of a positioner according to the invention. The positioner comprises two valve units, 10 and 12, hereafter named first and second valve units respectively. Each valve unit comprises basically the same components and configuration, why only the first valve unit, the left in FIG. 1, will be described in detail. When reference is made to the second valve unit, the same reference numerals will be used together with an asterisk (').

The valve unit comprises an air supply valve 14. The air supply valve comprises a shaft 16 arranged with an upper and a lower piston body, 18 and 20 respectively, as seen in FIG. 1, which piston bodies are arranged in an upper and lower chamber, 22, 24, respectively.

An intermediate chamber 26 is arranged between the upper and lower chambers with air passages between the three chambers arranged around the shaft. The shaft/piston body unit is biased in an upward direction in FIG. 1 by a pressure spring 28. The lower chamber is connected to an air supply source 32 via conduit 30. The upper chamber is divided in two parts by a flexible membrane 34 arranged to the upper surface of the upper piston body. The lower part of the upper chamber is in communication with the surrounding air. The intermediate chamber is connected to a conduit 38.

The second valve unit, the right unit in FIG. 1, is arranged with a further branching 38" of the conduit 38', which is connected to conduit 50' between the throttle valve 39' and the second air outlet valve 37'. Closing means 41 are arranged to the conduits 38' and 38" such that when one of the branches 38', 38" is open, the other branch is closed. The function of this configuration will be described in detail below.

A check valve 40 is arranged in the conduit allowing an airflow only from the supply valve. The conduit 38 is in turn connected to a conduit 50 running between with one chamber of an actuator (not shown) and a lower chamber 36 of an air outlet valve 37 hereafter named first outlet valve. As with the supply valve, the outlet valve is arranged with an intermediate and an upper chamber, 35, 40, with a shaft 42 arranged with an upper piston body 44 arranged in the upper chamber and a lower piston body 46 arranged in the lower chamber. Pressure spring 48 urges the shaft/piston body arrangement in an upward position. The upper chamber 40 is divided in two parts by a flexible membrane 34 arranged to the upper surface of the upper valve body. The intermediate chamber is connected to the surrounding air.

The positioner also comprises control and servo means one for each valve unit. The control and servo means comprises an electro-pneumatic valve 60, as for example a piezo-electrical valve. The piezo-electric valve is connected via electrical wires 62 to an electronic control unit (not shown) containing algorithms for controlling the positioner. An air supply conduit 63 is connected to the piezo-electric valve. The supply conduit is in turn connected to a pressurised air supply source 32 via a filter 64 and a pressure regulator 66. The piezo-electric valve is further arranged with a first outlet 68 to the surrounding air. The piezo-electric valve is provided with a flap 70, which flap, depending on being fed with an electrical voltage, either closes the inlet to the air supply conduit or the outlet.

The piezo-electrical valve is further provided with a second outlet conduit 72. The outlet conduit is in turn connected to a servo valve 74, 76. One of the servo valves 74, hereafter named first servo valve, the left valve in FIG. 1, comprises an upper chamber 78 divided in two parts by a flexible membrane 80, an intermediate chamber 86 and a lower chamber 88. The membrane is arranged to an upper surface of an upper piston body 82. The upper piston body is attached to a shaft 84 running through the chambers with passages around. A lower piston body 90 i attached to the shaft and arranged in the lower chamber. The shaft/valve body unit is biased upwards by a pressure spring 92. The lower chamber is connected to the pressurised air supply after the pressure regulator. The intermediate camber is connected via a conduit 94 to the upper part of the upper chamber of the first air supply valve 14. The conduit is branched and connected to the upper part of the upper chamber of the second air outlet valve 37'. The lower part of the upper chamber of the servo valve is connected to the outside air.

The second servo valve 76 has a somewhat different design. It comprises an upper chamber 96 divided in two parts by a flexible membrane. The upper part of the upper chamber is connected via a conduit 98 to the second outlet of the second piezo-electrical valve 60'. The lower part of the upper chamber is connected to the outside air. An upper piston body 100 is arranged in the lower part of the upper chamber and arranged to the membrane. The upper piston body is attached to a shaft 102 running through an opening in a dividing wall. A lower piston body 104 is attached to the shaft and arranged in a lower chamber 106 formed by the dividing wall.

The lower chamber is arranged with an air inlet connected via a conduit 108 to the pressurised air supply after the pressure-reducing valve. The lower chamber is further arranged with an outlet which is connected via a conduit 110 to the upper part of the upper chamber 22' of the second air supply valve 14'. The conduit is branched and connected to the upper part of the upper chamber 40 of the first air outlet valve 37.

The function of the positioner is as follows when connected to a double-acting actuator, for example a piston/cylinder arrangement acting in both ways. When the positioner is in a non-active state, i e no current is supplied to the piezo-electrical valves, FIG. 1, air is supplied by the pressurised air supply 32 to the lower chambers of the air supply valves 14, 14'. Air is further supplied through the filter 64 and the pressure-reducing valve where the pressure is reduced. First turning to the second valve unit, the right unit in FIG. 1, since the piezo-electrical valve is closed, no air can pass through there. Air enters the lower chamber 106 of the second servo valve 76 whereby the air pressure acts on the lower piston body, thereby closing the passage between the lower and the upper chambers. The air is then directed via conduit 110 to the upper part of the upper chamber 22' of the second air supply valve whereby the air pressure forces the shaft/piston body unit downwards against the spring pressure. This displacement downward opens a communication between the lower chamber and the intermediate chamber but closes the communication between the intermediate chamber and the upper chamber. Pressurised air from the air source is then directed via conduit 30' through the lower and intermediate chambers and to the conduit 38'.

Air from the servo valve is also directed to the upper part of the first air outlet valve 37 whereby the pressure from the air on the membrane forces the shaft/piston unit downwards against the spring force, thereby opening a communication between the lower and the intermediate chambers and closing the communication between the intermediate and the upper chambers.

Now turning to the first valve unit, since the piezo-electrical valve is closed the membrane 80 of the first servo valve is unaffected and the spring 92 urges the shaft/valve unit upwards. In this position the communication between the lower and the intermediate chamber is closed whereby pressurised air supplied to the lower chamber cannot be led further. This means that the first air supply valve and the second air outlet valve are unaffected. This in turn means that the communication between the lower chamber and the intermediate chamber of the first air supply valve is closed preventing pressurised air from the supply source 32 via the conduit 30 to pass through the valve. As regards the second air outlet valve 37' the communication between the lower and the intermediate chamber is closed. When the positioner is used for controlling a double acting actuator, the branch 38" is closed and air from the conduit 38' is directed to conduit 50' which air enters the lower chamber via the throttle valve. Since the lower chamber is closed air is led via conduit 50' to the actuator, thereby moving it in one direction. Air from the other actuator chamber is forced by the movement through the conduit 50 into the lower chamber 36 of the first air outlet chamber 37, into the intermediate chamber and out into the surrounding air. Because of the adjustable throttle valve 39 the airflow rate out from the actuator chamber can be controlled to obtain the desired speed of the actuator and the desired pressure.

Figure 2:
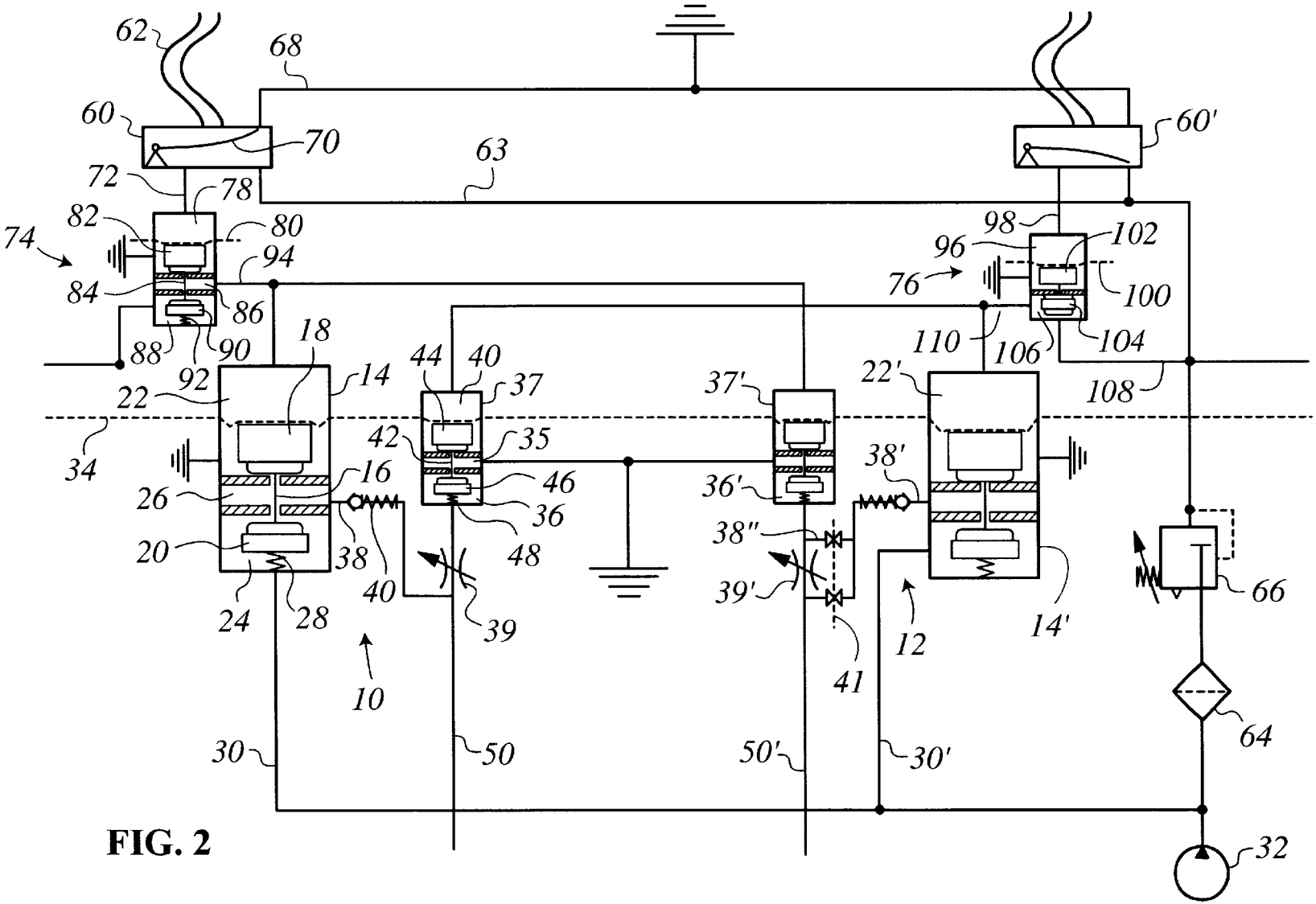
FIGS. 2–4 show the connection diagram of FIG. 1 with the control valves in different positions.

If the first piezo-electrical valve 60 now is actuated, FIG. 2, its flap will open the air inlet and close the outlet. Pressurised air from the pressure source via conduit 62 will then be directed via conduit 72 into the upper chamber of the first servo valve, whereby the pressure on the membrane forces the shaft/piston unit downwards, thereby opening the communication between the lower chamber and the intermediate chamber and closing the communication between the intermediate chamber and the upper chamber. Pressurised air is then directed through the servo valve and into the upper chamber 37' of the second air outlet valve via conduit 94. The air acting on the membrane causes the shaft/piston unit downwards, thereby opening the communication between the lower chamber and the intermediate chamber. The pressurised air from the second air supply valve will now go through the intermediate opening and out into the surrounding air instead of to the actuator, taking the easiest way. In this position of the control valves, the actuator is pressure-less.

Figure 3:
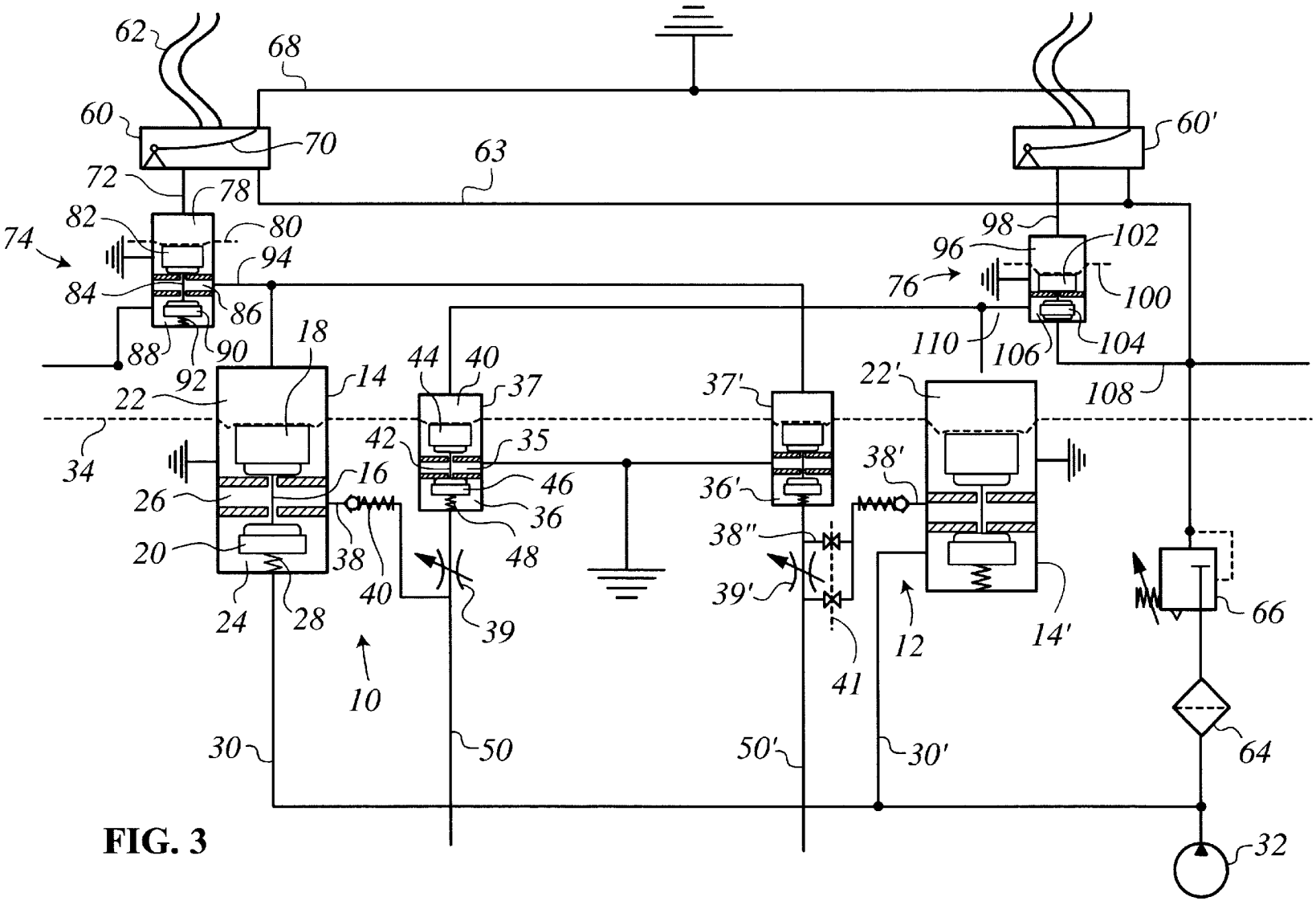

If the second piezo-electrical valve now is actuated its flap will open the air inlet and close the outlet, FIG. 3. Pressurised air will then be directed into the upper chamber of the second servo valve via conduit 98, whereby the pressure on the membrane will force the shaft/piston unit downwards thereby creating a communication between the lower and upper chamber and thus to the surrounding air. The lower piston will then close the air inlet into the lower chamber. Because of the closing of the air inlet and communication with the surrounding air, the upper chambers of the second air supply valve and the first air outlet valve will become pressure-less. This will cause the second inlet valve to close the supply of pressurised air through the valve and the first outlet valve to close the communication with the surrounding air. Pressurised air through the first air supply valve will then be directed to the other chamber of the actuator via conduit 50, thereby moving the actuator in the opposite direction as in FIG. 1.

Figure 4:
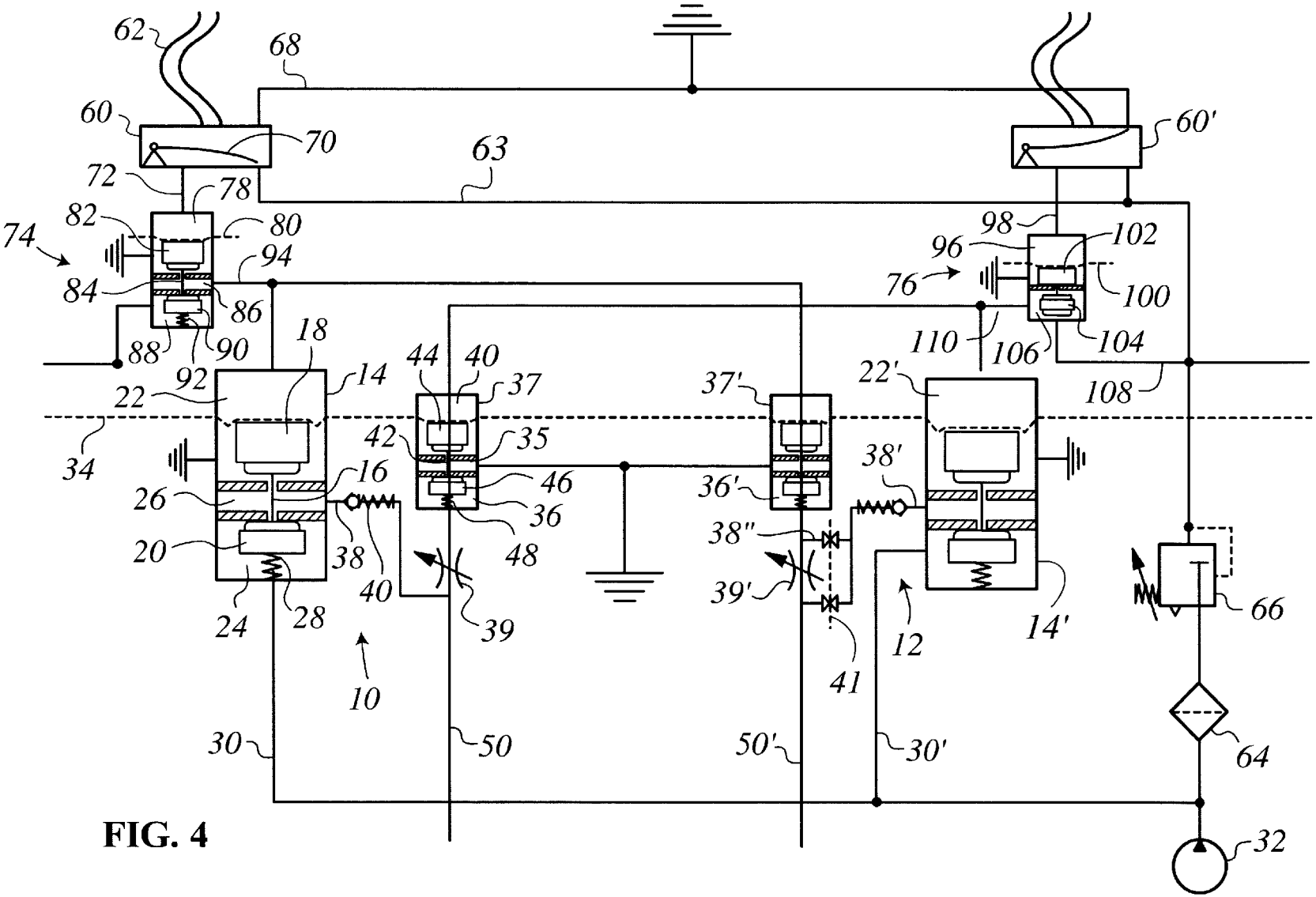

If the first piezo-electrical valve 60 is de-activated so that it closes the air supply inlet, FIG. 4, the upper chamber of the first servo valve will become pressure-less. The supply of pressurised air through the valve will then be closed, which in turn causes the upper chamber of the first air supply valve to become pressure-less and the supply of pressurised air through the valve will be closed. Further, the upper chamber of the second air outlet valve will also become pressure-less, thereby closing the communication between the actuator conduit 50' and the surrounding air. Thus, in this position all in- and outlets are closed.

When the positioner is to be used for single acting actuators, e. g. piston/cylinder arrangement moved by pressurised air in one direction and by spring means in the other direction, the closing means 41 is arranged such that conduit 38' is closed and conduit 38" is opened. The conduit 50 is then disconnected from the first actuator chamber whereby it is connected to the outside air. When using the positioner for single action, the second valve unit is used for supplying air to the actuator and the positions of the control valves used are as described earlier in connection with FIGS. 1, 3 and 4, that is, when both control valves are closed, FIG. 1, when both control valves are open, FIG. 3, and when the first control valves is closed and the second control valve is open, FIG. 4.

When the control valves are as in FIG. 1, as described earlier pressurised air is supplied to the second air supply valve via conduit 30'. The air is directed through conduit 38", and because the lower chamber of the second air outlet valve is closed, is directed through the conduit 50'. Because conduit 38" is connected to conduit 50' between the air outlet valve and the throttle valve, the air pressure will be reduced before entering the second chamber of the actuator. Because the actuating air in conduit 50' is directed through the throttle valve 39' a controlled movement of the actuator against its spring force is obtained.

For a return movement of the actuator, the control valves are positioned as shown in FIG. 3. In this position the second outlet valve 37' is open to the outside air. The spring force of the actuator will then force air out of the previously pressurised chamber through the conduit 50' via throttle valve 39' and out into the surrounding air. The setting of the throttle valve 39' will provide the return movement characteristics of the actuator.

When the valves are in the positions shown in FIG. 4 the second air inlet valve 14' and the second air outlet valve are closed thereby blocking the air inside the second chamber of the actuator. Since the spring force acts against the blocked air, the actuator is positioned in a certain position.

What is claimed is:

1. An electro-pneumatic positioner for use with a pneumatically controlled two chamber actuator, the positioner comprising:

a first valve unit including a first air supply valve and a first outlet valve connected to a conduit, which in turn is connected to a chamber of the actuator;

a second valve unit comprising a second air supply valve and a second air outlet valve connected to a conduit, which in turn is connected to a second chamber of the actuator;

a first control device acting on the first air supply valve, the first control device comprising a first electro-mechanical control valve controlling a first air supply connected to supply pressurized air to the first air supply valve; and a second control device acting on the second air supply valve, the second control device comprising a second electro-mechanical control valve controlling a second air supply connected to supply pressurized air to the second air supply valve, wherein the first air supply is connected to supply air to the second air outlet valve and the second air supply is connected to supply air to the first air outlet valve.

2. The electro-pneumatic position of claim 1 wherein the first and second electro-mechanical control valves are electro-pneumatic valves that generate pressurized air, the pressurized air being directed to control a corresponding air supply valve.

3. The electro-pneumatic positioner of claim 2 wherein the air supplies comprise servo valves.

4. The electro-pneumatic positioner of claim 1 wherein each air supply is capable of supplying a substantially larger air flow rate than the control valves are capable of supplying to control the air supplies.

5. The electro-pneumatic positioner of claim 1 wherein the air supplies comprise servo valves.

6. The electro-pneumatic positioner of claim 1 further comprising connecting conduits connecting the air supplies to one or more air supply sources and pressure reducers arranged in the connecting conduits.

7. The electro-pneumatic positioner of claim 1 further comprising throttles arranged in air outlet conduits of the actuator.

8. An electro-pneumatic positioner for use with a pneumatically controlled single-acting actuator, the positioner comprising:

a valve unit comprising an air supply valve and an air outlet valve connected to a conduit, which in turn is connected to a chamber of the actuator;

a first control device acting on the air supply valve, the first control device comprising a first electro-mechanical control valve controlling a first air supply connected to supply pressurized air to the air supply valve; and a second control device acting on the air outlet valve, the second control device comprising a second electro-mechanical control valve controlling a second air supply connected to supply pressurized air to the air outlet valve.

9. The electro-pneumatic position of claim 8 wherein the first and second electro-mechanical control valves are electro-pneumatic valves that generate pressurized air, the pressurized air being directed to control a corresponding air supply valve.

10. The electro-pneumatic positioner of claim 9 wherein the air supplies comprise servo valves.

11. The electro-pneumatic positioner of claim 8 wherein each air supply is capable of supplying a substantially larger air flow rate than the control valves are capable of supplying to control the air supplies.

12. The electro-pneumatic positioner of claim 8 wherein the air supplies comprise servo valves.

13. The electro-pneumatic positioner of claim 8 further comprising connecting conduits connecting the air supplies to one or more air supply sources and pressure reducers arranged in the connecting conduits.

14. The electro-pneumatic positioner of claim 8 further comprising throttles arranged in air outlet conduits of the actuator.

* * * * *